US007690080B1

(12) United States Patent
Coffman, II

(10) Patent No.: US 7,690,080 B1
(45) Date of Patent: Apr. 6, 2010

(54) DOOR STOP

(75) Inventor: Charles Walter Coffman, II, Austin, TX (US)

(73) Assignee: Sensor Safe, Inc., Austin, TX (US)

( * ) Notice: Subject to any disclaimer, the term of this patent is extended or adjusted under 35 U.S.C. 154(b) by 7 days.

(21) Appl. No.: 11/900,404

(22) Filed: Sep. 11, 2007

Related U.S. Application Data

(60) Provisional application No. 60/843,648, filed on Sep. 11, 2006.

(51) Int. Cl.
*E55F 5/02* (2006.01)

(52) U.S. Cl. ..... 16/82

(58) Field of Classification Search ..... 16/82, 16/343

See application file for complete search history.

(56) References Cited

U.S. PATENT DOCUMENTS 372,655 A * 11/1887 Cashin ..... 292/343
593,750 A * 11/1897 Marks ..... 239/348
776,378 A * 11/1904 Bellamy ..... 292/343
947,805 A * 2/1910 Dumont ..... 292/343
1,119,650 A * 12/1914 Smith ..... 292/343
1,154,148 A * 9/1915 West ..... 292/343
1,766,183 A * 6/1930 Mealia ..... 16/82
D164,467 S 9/1951 Arnold
2,760,223 A 8/1956 Walz
3,706,112 A * 12/1972 Newell ..... 16/82
3,836,118 A 9/1974 Meyer
4,135,335 A 1/1979 Jensen
D257,761 S 1/1981 Abel
4,776,548 A 10/1988 Bezenek
4,830,320 A 5/1989 Bellows
5,011,203 A * 4/1991 Tackett ..... 292/343
5,207,464 A * 5/1993 Reeves, Jr. ..... 292/339
5,249,767 A 10/1993 Mellen
5,368,349 A * 11/1994 Hebert et al. ..... 292/343
5,552,768 A * 9/1996 Mikiel et al. ..... 340/546
D387,658 S 12/1997 Van Etten
5,697,656 A * 12/1997 Hebert et al. ..... 292/343
5,711,560 A * 1/1998 Gilbertson ..... 292/343
D421,374 S 3/2000 Montgomery
6,161,252 A * 12/2000 Rodriguez ..... 16/82
6,345,413 B1 * 2/2002 Fletcher et al. ..... 16/82
6,345,849 B1 * 2/2002 Yen ..... 292/343
6,616,128 B2 9/2003 Selzer
6,727,805 B2 * 4/2004 Hollister et al. ..... 340/326
7,156,431 B2 1/2007 Norgaard
2005/0225100 A1 * 10/2005 Pendergrass ..... 292/343
2007/0271731 A1 * 11/2007 Fuller ..... 16/82

FOREIGN PATENT DOCUMENTS

JP 2000120316 A * 4/2000
JP 2002089118 A * 3/2002
JP 2004278233 A * 10/2004

* cited by examiner

*Primary Examiner*—Victor Batson
*Assistant Examiner*—Matthew Sullivan
(74) *Attorney, Agent, or Firm*—Michael K. Dixon; Akerman Senterfitt

(57) ABSTRACT

An apparatus is disclosed having a first wedge having a first side and a second side oriented at some angle relative to the first side, and a second wedge glidably connected to the first wedge, having a first side and a second side oriented at some angle relative to the first side. The first wedge glides relative to the second wedge to stop the door before the door stop reaches a maximum length of travel.

16 Claims, 5 Drawing Sheets

DOOR STOP

RELATED APPLICATIONS

This application claims a benefit of priority to U.S. Provisional Patent Application No. 60/843,648 by inventor Chuck Coffman, entitled "Door Stop Assembly" filed on Sep. 11, 2006, the entire contents of which are hereby expressly incorporated by reference for all purposes.

TECHNICAL FIELD OF THE DISCLOSURE

The present invention pertains to door stops. In particular, the present invention describes a door stop apparatus having two or more, wedges movably connected to prevent a door from opening or closing.

BACKGROUND OF THE DISCLOSURE

Door stops are devices used to hold a door open or closed. There are several types of door stops including attachable and stand-alone ones.

Attachable door stop devices are mounted or otherwise affixed to a wall, floor or door. One example of an attachable door stop is a stopping mechanism, usually a short metal bar capped with rubber or other high friction material and attached to a hinge.

When the door is to be kept open, the bar is swung down so that the rubber end touches the floor. However, the hinge is permanently mounted on the door. If the door is an exterior door and the door stop is used to keep the door open, the exterior surface of the door (i.e., the face) will have a door stop mounted thereon. If the face is a decorative face, a door stop may give the door an undesirable look.

Stand-alone door stop devices may be as primitive as a rock or a brick. Generally, stand-alone door stops are preferred as they are easy to install and relatively inexpensive. To hold a door open or closed, it can be as easy as placing a heavy object behind or in front of the door. These stops are predominantly improvised. Wedges made of wood, rubber, plastic and other materials are another approach to holding a door open. The wedge is kicked into position and the compressibility of the material is used to try to create enough friction to keep the door from shutting. A problem with prior art wedge designs is that if the angle of the wedge is too steep, the door will push the wedge out of the way due to the hardness and/or low friction coefficient of the floor. Also, if the floor is slick or has dust or debris on it, the wedge may slide. Furthermore, these door stops must be in a certain orientation to work. Furthermore, these door stops cause damage to floor and door from the friction of insertions. Removal of same can often time split the door laminate from the door frame.

Some prior art attempts to keep doors open or closed rely on the weight of the object. The weight may damage the floor and a person may be injured by accidentally striking the object, such as with a toe.

In some settings a floor may be covered with carpet, linoleum, tile, or some other surface. In this type of setting a problem that arises is that the floor may deform. For example, plush carpet may be compressed. If a prior art wedge is used, the maximum thickness of the wedge may be small enough that the door may compress the wedge into the carpet and then pass over the wedge, rendering it useless.

In addition to keeping a door from closing, door stops are also commonly used to prevent a door from opening past a certain angle. Doors that open too wide may damage walls when a doorknob contacts the wall, or may damage the hinges by overextending their range. The most common form of door stop for this purpose is to have a device permanently mounted to either the floor, the door, or a wall so that the door or some feature on the door contacts the door stop before the door can do any damage to the door or wall. A prior art approach involves drilling a hole in the floor and setting a pin in the hole to anchor a door stop with a rubber face. When the door swings open, the door contacts the rubber face in a relatively elastic collision that absorbs some of the momentum, but the remaining inertia is transferred to the pin. Over time, the pins can break or damage the surrounding concrete or other flooring material and must be replaced. Also, the hinges may be damaged by the vibration.

Furthermore, in the case of commercial or automatic return doors, almost all of these door stops will not operate unless they are wedged into place with considerable force, further increasing the likely hood of damage to the door or floor. If the door is even slightly bumped, the door stop is unseated and will not stop the spring loaded force of the door, particularly on smooth surfaces.

Simple wedge door stops almost all use a single hardness material that makes contact with the door and the floor resulting in an approach that may be the worst of both worlds. The surface making contact with the floor is often too rigid or hard to conform to the surface of the floor and provide desirable gripping power or surface tension of softer materials. The upper side making contact with the door is generally not of a high enough hardness to facilitate effective durability of the product, resulting in a short life product that at best is challenging and limited in use. A simple wedge design such a wood block eventually turns into a sandpaper block as dirt, sand and debris particles are through friction embedded in the surface giving the erosive effect of a glacier on a mountain with a door stop against smooth floors.

SUMMARY OF THE DISCLOSURE

Embodiments of the disclosed door stop facilitate a free standing hand placed door stop that does not require manual or forced insertion. One embodiment of the present invention is directed to a door stop having two or more components glidably connected. In one embodiment, the first component may be a first wedge with a first side and a second side oriented at some angle relative to the first side, and a second wedge movably connected to the first wedge also having a first side and a second side oriented at some angle relative to the first side. In some embodiments, the system includes a bearing for rolling contact between the first and second wedges. In some embodiments, the second side of the first wedge defines a curvilinear path, wherein the second side of the second wedge comprises a complementary profile for moving the first wedge relative to the second wedge. In some embodiments, the system further comprises one or more extensions on the first side of the first or second wedge, comprising a first surface oriented normal to the first side of the second wedge and a second surface oriented parallel to the first side of the second wedge, wherein the first surface engages the side of a door during initial contact with the door, and wherein the first wedge slides relative to the second wedge such that the second surface engages the bottom of the door. In some embodiments, the system further comprises a semi-rigid member on the first side of the first or second wedge. In some embodiments, the system further comprises a plurality of ribs on the first side of the first or second wedge.

In some embodiments, a door stop may incorporate a first wedge with a first side having a first hardness and a second wedge having a first side with a second hardness. In one embodiment, a door stop having sides with different hardness ratings may use a softer material for floor contact which conforms more to the surface below it, increasing the surface area or contact area with the floor. This lower hardness also provides much greater surface tension to hold the base where it is placed. The upper portion making contact with the door may utilize a much higher hardness material that provides a much longer life material that reduces or eliminates deterioration of the door stop or the door to which it makes contact.

In some embodiments, the system further comprises a sensor. In some embodiments, a sensor detects smoke. In some embodiments, a sensor detects motion between the first and second wedges. This may also include a sensitivity or movement or vibration sensor which will trigger an alarm if tampered with, such as an attempt to remove the doorstop. In some embodiments, the system includes a light source, such as a strobe light. In some embodiments, the door stop includes an audible signal. In some embodiments, the system includes a lanyard attached to the first wedge, wherein pulling on the lanyard pulls the first wedge relative to the second wedge to disengage the door stop from the door. In some embodiments, the first side of the first or second wedge is oriented at an angle between 6 and 40 degrees relative to the second side. In some embodiments, the system includes an adhesive member having a first adhesive surface for affixing to the first side of the first wedge and a second adhesive surface for affixing with a floor.

One embodiment of the present invention is directed to a door stop comprising a first wedge having a first side and a second side oriented at an angle relative to the first side; and a second wedge connected to the first side and having a first side and a second side oriented at an angle relative to the first side, wherein movement of a door in contact with the door stop moves the first wedge relative to the second wedge to apply a force on the door to inhibit further movement of the door.

One embodiment of the present invention is directed to a door stop, comprising a wedge with a side with a hardness for contact with a door and a side with a hardness for contact with a floor, wherein the floor side is softer than the door side.

Embodiments disclosed herein may have many advantages. For example, as movement of a door in contact with a top wedge of one embodiment of a door stop moves the top wedge relative to a bottom wedge, the bottom wedge remains in place and in contact with the floor. Advantageously, embodiments of the door stop may be used without drilling holes in floors, and without leaving marks on the floor.

Since the angle of the bottom wedge can be very small (e.g., 6 degrees), embodiment disclosed herein may fit under low-clearance doors. Furthermore, a configuration in which the door stop can fit under the door allows the top wedge to apply substantially vertical forces on the door. This, in combination with the door stop being manufactured from hard material, prevents the door stop from damaging the door, such as by pulling on the edge of a laminated door. The increased hardness of the door stop also endures more wear and tear from repeated use, for longer use of the door stop.

Embodiments of a door stop may be configured for use in different settings. In some embodiments, the angle of one or both wedges may range up to 40 degrees to configure a door stop with an overall angle of up to 80 degrees. Advantageously, embodiments with a higher overall angle may provide improved performance on carpet or other soft surfaces. In some embodiments, Embodiments may advantageously include a sensor to detect smoke, movement, or an intrusion attempt, or other unsafe condition.

Embodiments may provide visual, auditory or wireless signals.

These, and other, aspects of the disclosure will be better appreciated and understood when considered in conjunction with the following description and the accompanying drawings. The following description, while indicating various embodiments of the disclosure and numerous specific details thereof, is given by way of illustration and not of limitation. Many substitutions, modifications, additions or rearrangements may be made within the scope of the disclosure, and the disclosure includes all such substitutions, modifications, additions or rearrangements.

BRIEF DESCRIPTION OF THE FIGURES

A more complete understanding of the present disclosure and the advantages thereof may be acquired by referring to the following description, taken in conjunction with the accompanying drawings in which like reference numbers indicate like features and wherein.

DETAILED DESCRIPTION OF THE DISCLOSURE

The disclosure and the various features and advantageous details thereof are explained more fully with reference to the non-limiting embodiments that are illustrated in the accompanying drawings and detailed in the following description. Descriptions of well known starting materials, processing techniques, components and equipment are omitted so as not to unnecessarily obscure the disclosure in detail. Skilled artisans should understand, however, that the detailed description and the specific examples, while disclosing preferred embodiments of the disclosure, are given by way of illustration only and not by way of limitation. Various substitutions, modifications, additions or rearrangements within the scope of the underlying inventive concept(s) will become apparent to those skilled in the art after reading this disclosure.

Embodiments of the disclosure may be particularly useful for preventing doors from moving, such as by opening or closing about a hinged axis, thus it is in this context that embodiments of the disclosure may be described. It will be appreciated, however, that embodiments of the systems and methods of the present disclosure may be applicable for preventing motion of other objects.

Figure 1:
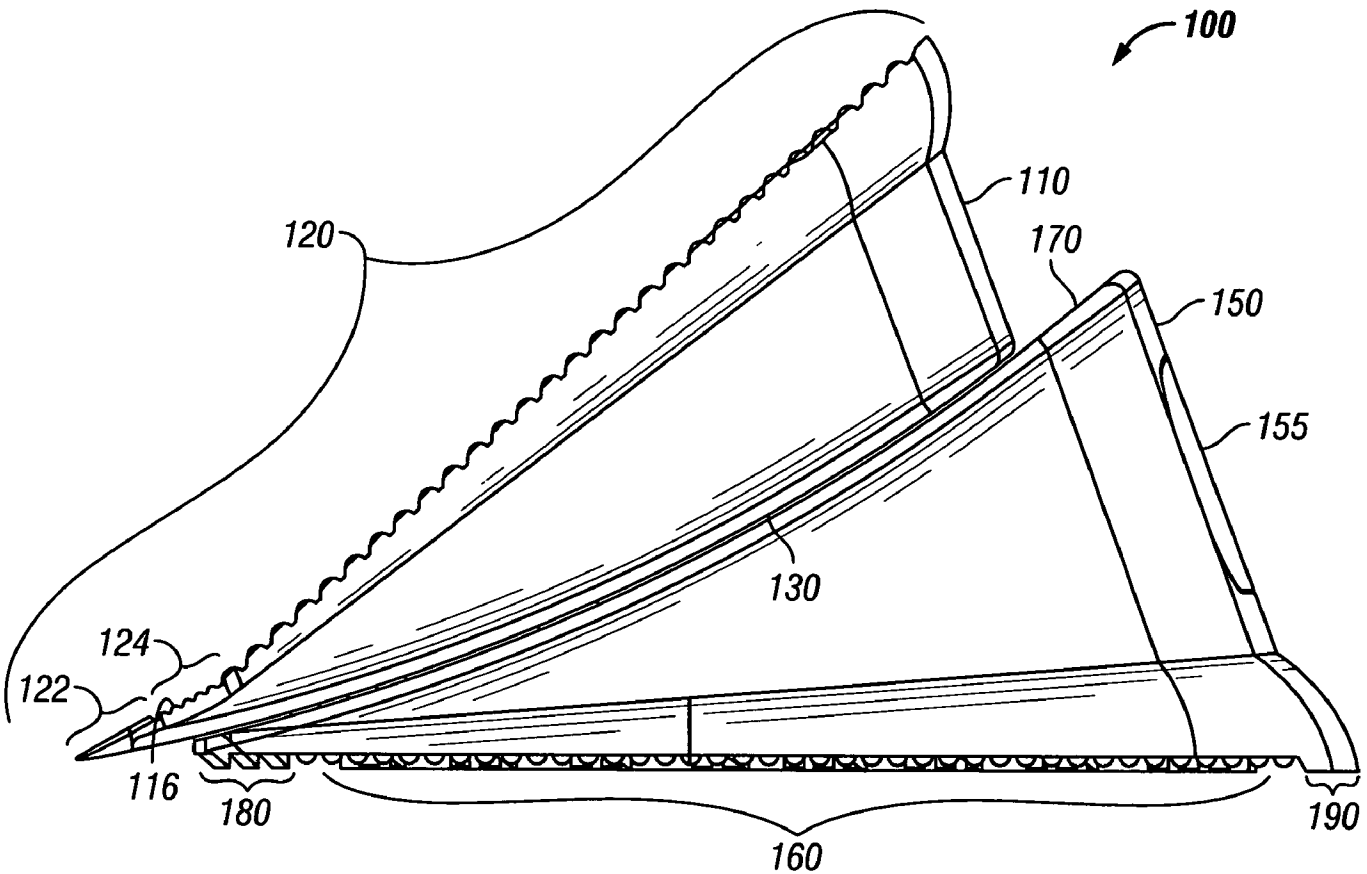
FIG. 1 depicts a side view of one embodiment of a system for inhibiting movement of a door.

FIG. 1 depicts a side view of one embodiment of door stop 100 having first wedge 110 movably connected to second wedge 150. As used herein, the term glide refers to motion resulting from low friction. Gliding may be the result of two objects that move relative to each other by sliding, such as over a lubricated surface. Gliding may include an object rolling over bearings.

In some embodiments, door stop 100 may utilize the weight of the door, the clearance under the door, the design of the door, or the design or configuration of the hinges supporting the door to counter the horizontal forces exerted by the door. Embodiments of door stop 100 may prevent the door from opening (or closing, depending on the placement of door stop 100), on slick or dusty floors (i.e., low friction surfaces), carpet, and other flooring situations. In some embodiments, door stop 100 may be easy to remove from the door, because door stop 100 does not need to be forcibly jammed under a door to prevent the door from moving. Furthermore, the binding forces normally applied to door hinges and frames are reduced, thereby helping to extend the life of hinges and preventing damage to the door. In some embodiments, door stop 100 does not slip on slick (i.e., low friction) floors. In some embodiments, door stop 100 is lighter than weighted door stops, making it easier to carry around. In some embodiments, door stop 100 does not compress easily, so it is less likely to be damaged from wear and tear normally associated with wedge style door stops. In some embodiments, door stop 100 may not mark up floors because its floor contacting surface does not slide easily.

In some embodiments, first wedge 110 may glide relative to second wedge 150 through a length of travel. In some embodiments, glide motion between first wedge 110 and second wedge 150 is rectilinear. In some embodiments, glide motion between first wedge 110 and second wedge 150 is curvilinear. In some embodiments, substantially horizontal forces exerted by the door on first wedge 110 causes glide motion of first wedge 110 relative to second wedge 150. By deflecting the horizontal inertia of the door onto a glide plane at some angle relative to the ground (i.e., the angle of attack for second wedge 150), door stop 100 may stop the door even on low friction floors.

In some embodiments, first wedge 110 includes first side 120 and second side 130 oriented at an angle to first side 120. In some embodiments, the angle between first side 120 and second side 130 is between 3 and 40 degrees. In some embodiments, a smaller angle between first side 120 and second side 130 of first wedge 110 may be advantageous for applications in which the floor is hard or has a low friction coefficient. A hard floor may be concrete, wood, granite or some other material. A low friction coefficient for a floor may be the result of the material used to manufacture the floor. A low friction coefficient for a floor may be the result of polish, wax, or other treatments to the floor. A low friction coefficient for a floor may be the result of dust or debris that has accumulated on the floor. Using door stop 100 with a small angle between first side 120 and second side 130 creates a low angle of attack for first wedge 110. A low angle of attack and a low friction coefficient between first wedge 110 and second wedge 150 enables second wedge 150 to remain in place while first wedge 110 may glide relative to second wedge 150 to stop the door. In some embodiments, a larger angle between first side 120 and second side 130 of first wedge 110 may be advantageous for applications in which the floor is soft or pliant (e.g. carpeted).

In some embodiments, first side 120 may include leading edge 122. In some embodiments, leading edge 122 may fit beneath a low profile door (i.e., a door with less than ¼ inch clearance between the bottom of the door and the floor). In some embodiments, first side 120 may include transition section 124. In some embodiments, transition section 124 may include one or more features 126. In some embodiments, one or more features 126 on transition section 124 for contact with weatherstripping, trim, or other features on a door.

In some embodiments, the angle of first side 120 to second side 130 may vary along first wedge 110 or second wedge 150. For example, in the embodiment depicted in FIG. 1, the angle between first side 120 and second side 130 is different in each of leading edge 122 and transition section 124. In some embodiments, second side 130 may be curved. In some embodiments, second side 130 may have a variable curvature.

In some embodiments, second wedge 150 may include first side 160 and second side 170 oriented at an angle to first side 160. In some embodiments, first side 160 of second wedge 150 may include leading edge 180 and trailing edge 190. In some embodiments, leading edge 180 of second wedge 150 may fit under a low clearance door. Advantageously, door stop 100 may be used in commercial settings with low clearance doors or tiled floors, construction settings with debris and dust, or in residential settings with plush carpet and decorative floors. In some embodiments, trailing edge 190 of second wedge 150 may extend a distance beyond first wedge 110 or second wedge 150. In some embodiments, trailing edge 190 may extend such that when trailing edge 190 abuts a wall, door stop 100 is configured such that a door may not contact wall. In some embodiments, trailing edge 190 extends such that a door knob on a door may not contact a wall. In other words, when door stop 100 is positioned such that trailing edge 190 abuts a wall, first wedge 110 may be able to glide relative to second wedge 150 to inhibit movement by the door without the doorknob contacting the wall. Furthermore, door stop 100 may be able to stop the door before first wedge 110 reaches the maximum length of travel.

In some embodiments, second wedge 150 may include recess 155. In some embodiments, recess 155 may be used for placement of a logo, nameplate, or other label. In some embodiments, recess 155 may include a light, alarm, or sensor.

In some embodiments, the friction coefficient between second side 130 of first wedge 110 and second side 170 of second wedge 150 is minimized to facilitate first wedge 110 gliding relative to second wedge 150. In some embodiments, the friction coefficient between second side 130 and second side 170 is less than the friction coefficient between door stop 100 and the floor. In some embodiments, a low friction coefficient may be the result of the material used to manufacture first wedge 110 or second wedge 150, the result of manufacturing first wedge 110 or second wedge 150 with a layer or coating having a low friction coefficient, or some combination. In some embodiments, a layer of material between first wedge 110 and second wedge 150 may enable first wedge 110 to glide relative to second wedge 150 with a sliding motion. In some embodiments, TEFLON® may reduce the friction coefficient between first wedge 110 and second wedge 150. In some embodiments, a lubricant such as oil may enable first wedge 110 to slide past second wedge 150.

In some embodiments, a layer of material may be mechanically, chemically, or thermally bonded to first wedge 110 or second wedge 150 to provide a desired friction coefficient. In some embodiments, the layer of material may have a certain texture to provide a desired friction coefficient.

In FIG. 1, door stop 100 is shown in a first position, in which first wedge 110 is on top of second wedge 150. In one embodiment, door stop 100 may be inverted such that second wedge 150 is on top of first wedge 110. Advantageously, embodiments in which first wedge 110 has a different angle than the angle for second wedge 150 may enable door stop 100 to have more than one orientation for use in other applications. For example, one embodiment may be advantageous on hard, low friction surfaces, and another orientation may be advantageous for carpeted settings. Thus, only one door stop 100 may be needed to keep a door open in which the floor is carpeted, the floor is slick, the floor has debris, the door is a low-clearance door, and other settings. This may be particularly advantageous for delivery persons who may enter and exit many doors in many settings in a single day.

Figure 2:
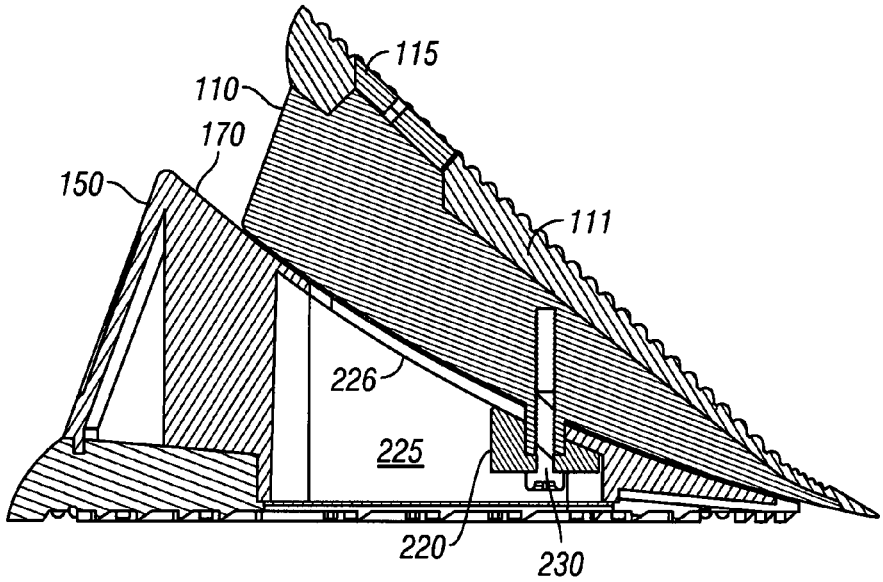
FIG. 2 depicts a side cross-sectional view of one embodiment of a door stop.

FIG. 2 depicts a side cross-sectional view of one embodiment of door stop 100. In some embodiments, first wedge 110 and second wedge 150 may comprise metal, alloys, wood, plastic, composite, polymers, ceramics, or a combination thereof.

In some embodiments, door stop 100 may be manufactured from a material that does not compress easily and therefore does not get damaged as easily as prior art wedges. In one embodiment, first wedge 110 and second wedge 150 may be made of non-deformable or essentially non-deformable material. In some embodiments, first wedge 110 or second wedge 150 may have an elastic modulus less than the elastic modulus for the door or the floor. In some embodiments, first wedge 110 and second wedge 150 may have a selected hardness or stiffness. In some embodiments, first wedge 110 and second wedge 150 may be manufactured having selected hardness or stiffness. In some embodiments, a layer of material having a selected hardness or stiffness may be joined to first wedge 110 and second wedge 150. One advantage of first wedge 110 and second wedge 150 having a hard or stiff surface is little or no deformation caused by repeated compression and stretching that may result in deterioration of door stop 100. In some embodiments, first wedge 110 or second wedge 150 or both may be manufactured with material having a Shore A hardness of 50 or higher. In some embodiments, ABS plastic having a Shore A hardness of 90 provides sufficient hardness to prevent door stop 100 from deforming or distorting. In some embodiments, the hardness of door stop 100 results in fewer marks on floors than door stops that rely on soft material. In some embodiments, layer 111 having a selected hardness may be mechanically, chemically, or thermally bonded to first wedge 110 or second wedge 150.

In some embodiments, first wedge 110 or second wedge 150 may be manufactured as a single body or may include multiple parts manufactured separately and then joined to form first wedge 110 or second wedge 150. In some embodiments, first wedge 110 and/or second wedge 150 may be substantially solid to support a door. In FIG. 2, first wedge 110 is shown as substantially solid.

In some embodiments, first wedge 110 and/or second wedge 150 may have hollow portions 225 but still support a portion of a door. In some embodiments, hollow portion 225 may be used to house a sensor. In some embodiments, hollow portion 225 may be used to house an auditory or visual indicator. In some embodiments, hollow portion 225 may be used to house an alarm. In some embodiments, hollow portion 225 may be used to house a light. In some embodiments, hollow portion 225 may be used to house a retractable lanyard. As used herein, the term lanyard refers to any string, cable, cord, rope, belt or band that, when pulled, exerts tension on an attachment point. One advantage of door stop 100 having a retractable lanyard is the ability for a person to conveniently retrieve door stop 100 after use. In some embodiments, first wedge 110 or second wedge 150 or both includes an attachment point for one end of a lanyard. In some embodiments, the lanyard is a retractable lanyard such that one end of the lanyard is permanently connected to door stop 100. In some embodiments, the other end of the lanyard may be long enough, looped, or both for wrapping the lanyard around a door knob. As an example, if a delivery person is handling large or heavy items and needs to retrieve door stop 100, he can position door stop 100 with a foot and wrap the lanyard around the door knob, then retrieve door stop 100 by unwrapping the lanyard from the door knob and pulling to release pressure from door stop 100. Door stop 100, however, may be retrieved by pulling on a lanyard because door stop 100 is not wedged under the door. In other words, pulling on the lanyard may be enough force to glide first wedge 110 relative to second wedge 150 to relieve pressure from the door, without pushing on the door or other assistance. Once first wedge 110 glides to relieve pressure and door stop 100 disengages the door, the lanyard may be retracted into door stop 100, effectively pulling a lightweight door stop to the person's hand without the person bending over. The lanyard may be conveniently attached to a door knob. One or more lights or sounds may be activated. For example, in one embodiment, door stop 100 may activate a sound to remind the delivery person that door stop 100 is in use, and may provide a reference to enable the delivery person to guide a load through a door in situations when the door has limited visibility. A light, such as a strobe light, may provide a visual clue. In some embodiments, a light and/or an audible signal may be used. For example, a firefighter may use door stop 100 to hold open a door in dark, smoky conditions. A light and/or audible signal may help locate the door.

In some embodiments, both first wedge 110 and second wedge 150 may have an attachment point for a lanyard, such as a loop. In these embodiments, when door stop 100 is applied to the door, first wedge 110 glides relative to second wedge 150 such that first wedge 110 overhangs second wedge 150 or second wedge 150 protrudes from under first wedge 110. In either situation, if a lanyard connects first wedge 110 and second wedge 150 with a simple loop, then when the lanyard is pulled, the tension is biased toward only one wedge. If the tension biases first wedge 110, then first wedge 110 glides relative to second wedge 150 due to the low resistance between the wedges, and the pressure on the door is released. Similarly, if second wedge 150 is recessed under first wedge 110, pulling on the lanyard biases second wedge 150, the low resistance between the wedges allows second wedge 150 to glide relative to first wedge 110, and the pressure on the door is relieved. Those skilled in the art will appreciate that due to the low resistance between first wedge 110 and second wedge 150, the effort required to extract door stop 100 having two wedges is less than the effort required to pull a single wedge door stop, especially if the single wedge has been forcibly applied in an effort to keep the door in place.

In some embodiments, first wedge 110 and/or second wedge 150 may be manufactured for minimum weight. One advantage of embodiments of door stop 100 configured for minimum weight is the transportability of door stop 100. Door stop 100 may be readily available to keep doors propped open.

In some embodiments, connection assembly 230 holds first wedge to second wedge 150. In some embodiments, bolt/nut assembly 230 connect wedges 110 and 150 so that wedges 110 and 150 may glide relative to each other until bolt/nut assembly 230 reaches a limit (i.e., maximum length of travel), but wedges 110 and 150 cannot be separated. In some embodiments, rivet 230 engaged with block 220 holds first wedge 110 to second wedge 150 such that first wedge 110 is glidably connected to second wedge 150. First wedge 110 may be connected to second wedge 150 using various connection assemblies that allow first wedge 110 to glide relative to second wedge 150.

In some embodiments, door stop 100 stops door from moving by first wedge 110 gliding relative to second wedge 150, before first wedge 110 reaches the maximum length of travel. In one embodiment, second wedge 150 may be configured to define the maximum length of travel between first wedge 110 and second wedge 150. In one embodiment, second edge 150 may be configured to define the maximum length of travel. For example, a lower angle between first side 160 and second side 170 may affect the maximum length of travel for bolt/nut assembly 230 to translate in second wedge 150. In one embodiment, first wedge 110 of door stop 100 may be configured to define the maximum length of travel between first wedge 110 and second wedge 150. In some embodiments, the position or angle of leading edge 122 may define the maximum length of travel for first wedge 110 relative to second wedge 150.

In some embodiments, first side 120 of first wedge 110 may include recessed area 115. In some embodiments, recessed area 115 may be reflective. In some embodiments, recessed area 115 may have a different hardness than layer 111 or first side 120. In some embodiments, recessed area 115 may be an insert for placement of a logo or other identification.

Figure 3:
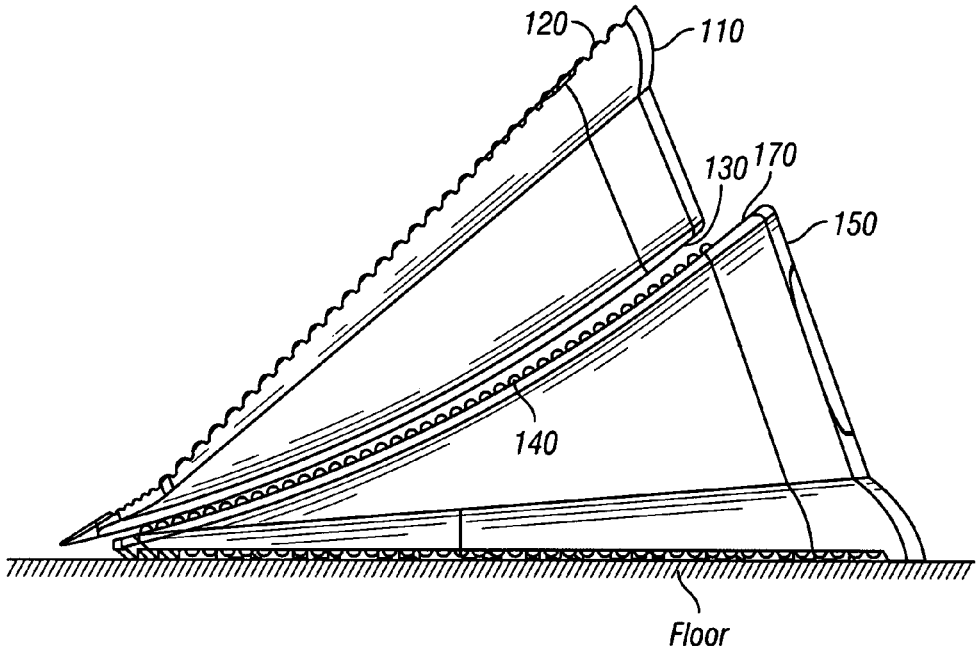
FIG. 3 depicts a side cross-sectional view of one embodiment of a door stop.

FIG. 3 depicts a side view of one embodiment of a system for inhibiting movement of a door, in which first wedge 110 and second wedge 150 may be movably connected.

In some embodiments, a plurality of bearings 140 provide low resistance between first wedge 110 and second wedge 150 to enable first wedge 110 to move relative to second wedge 150 when a door contacts first wedge 110. In some embodiments, bearings 140 comprise roller bearings. In some embodiments, bearings 140 comprise ball bearings. In some embodiments, bearings 140 may be rotatably connected to first wedge 110 or second wedge 150. In other words, in some embodiments, bearings 140 may be connected to an axis fixed relative to either first wedge 110 or second wedge 150 or may be captured between the two wedges 110 and 150 such that bearings 140 move with respect to either or both first wedge 110 and/or second wedge 150. In some embodiments, rollers, spherical bearings, or ball bearings may be contained in a housing positioned between wedges 110 and 150 to provide motion between first wedge 110 and second wedge 150. The housing (not shown) may be manufactured from steel, ceramic, or other materials that may support at least a portion of the door.

Figure 4:
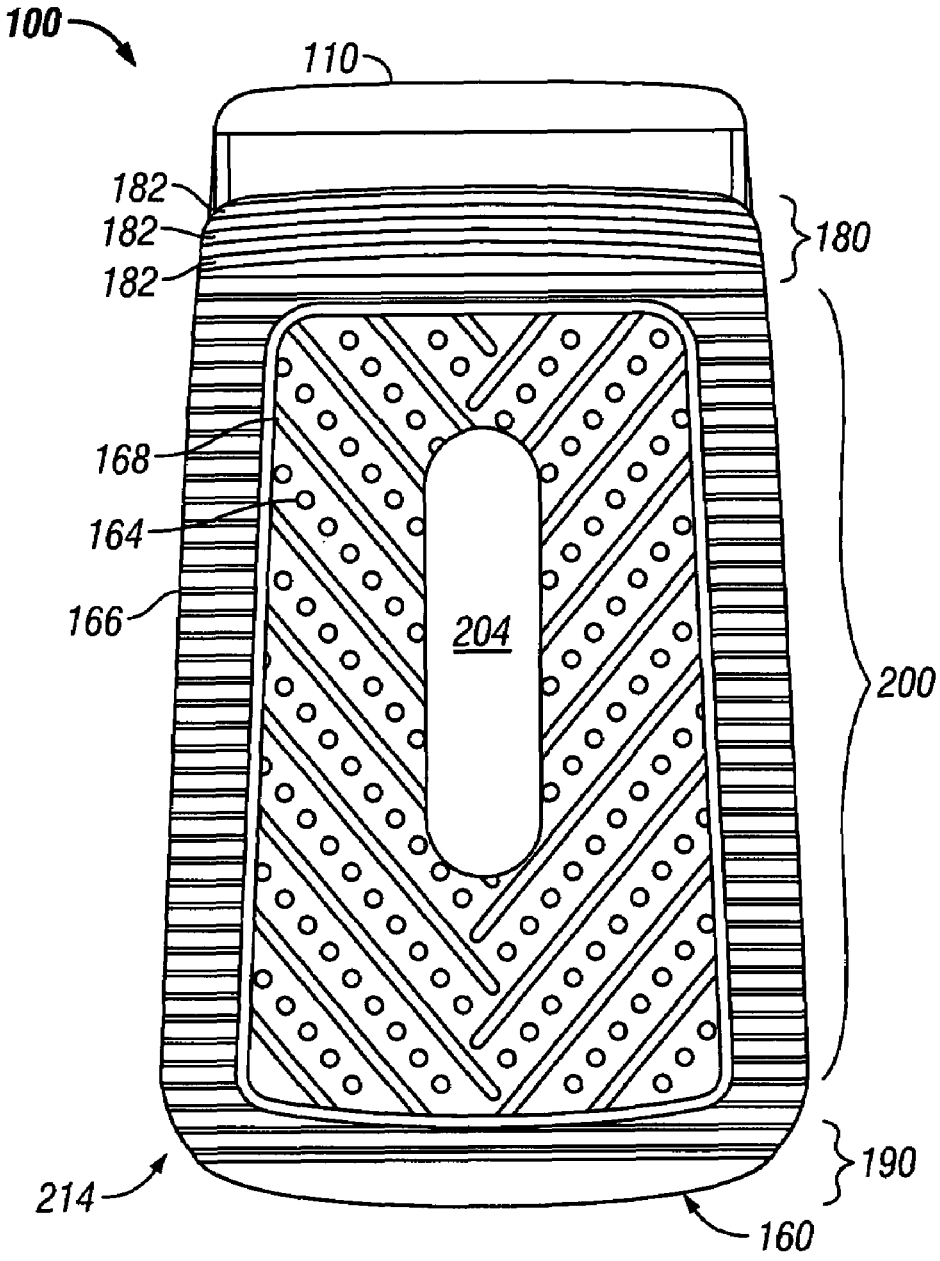
FIG. 4 depicts a bottom view of one embodiment of a door stop.

In some embodiments, first wedge 110 and second wedge 150 may contact a floor or other surface. FIG. 4 depicts a bottom view of one embodiment of door stop 100, showing first side 160 of second wedge 150.

In some embodiments, a portion of first side 160 of second wedge 150 has a Shore A hardness between 5 and 40. In some embodiments, elastomers, synthetic compounds, silicone, and natural rubber may have a Shore A hardness less than 40.

In some embodiments, the combination of first side 160 of second wedge 150 having a low Shore A hardness (e.g., 15 or less) and first side 120 of first wedge 110 having a high Shore hardness (e.g., 70 or greater) may reduce damage to the door and the door stop.

In some embodiments, first side 160 includes a plurality of extensions162, 164, 166, and/or 168. In some embodiments, extensions extensions162, 164,166, and/or 168 may contact a floor. In some embodiments, extensions extensions162, 164, 166, and/or 168 may contact a door. In some embodiments, extensions162, 164,166, and/or 168 may be used for contact with either a floor or a door.

In some embodiments, first side 160 may include resilient members 164. In some embodiments, resilient members 164 may be manufactured from material with low stiffness. One advantage of resilient material may be the ability for door stop 100 to function well on uneven surfaces such as tile or a door feature, or in situations with debris on the floor. In some embodiments, resilient members 164 may have an angled or curved profile. In some embodiments, one or more resilient members 164 may form a continuous feature across the width or length of first side 160. One advantage of door stop 100 in which first wedge 110 moves relative to second wedge 150 may be that horizontal forces exerted by a door on first wedge 110 can move first wedge 110 relative to second wedge 150 such that resilient members 164 are exposed to a substantially vertical compression force. In contrast, prior art approaches to stopping a door result in a shear force on the device. Over time, the application of shear forces the device may introduce tears or cracks in the material, resulting in undesirable material failure. Furthermore, some materials that may work well in compression may mark up the floor from attempts to force a soft material under a door.

In some embodiments, first side 160 may include semi-rigid members 168. Semi-rigid members 168 may be manufactured from material with a stiffness greater than the stiffness for resilient members 164. In some embodiments, semi-rigid members 168 may enable first side 160 of second wedge 150 to provide sufficient contact with a floor to prevent door stop 110 from moving when a door exerts a force on door stop 100. In some embodiments, semi-rigid members 168 may provide sufficient contact with a door to prevent the door from moving relative to second wedge 150 when door stop 100 is inverted. In some embodiments, semi-rigid members 168 may displace debris such as dust, dirt, sand, sawdust, construction material, and other particles. In some embodiments, semi-rigid members 168 may be at some angle such that debris is pushed such that debris does not accumulate in front of semi-rigid members 168. In some embodiments, semi-rigid members 168 may be configured for sliding contact with the floor. In some embodiments, semi-rigid members 168 may prevent debris from reaching resilient members 164.

In some embodiments, first side 160 may include outer edge 214. In some embodiments, outer edge 214 may have the same stiffness as other parts of first side 160. In some embodiments, outer edge 214 may have a higher stiffness than other parts of first side 160. In some embodiments, outer edge 214 may have a lower hardness than other parts of first side 160. One advantage to having first side 160 having more than one stiffness may be the ability for door stop 100 to function on uneven surfaces such as natural tile or with doors of irregular shape or rotating about a hinge.

In some embodiments, outer edge 214 of bottom surface 140 may include rigid members 166. In some embodiments, rigid members 166 may provide additional support to prevent first wedge 110 from moving along a floor when a door exerts a horizontal force on door stop 100. In some embodiments, one or more rigid members 166 may engage a door when door stop 100 is in an alternate (inverted) configuration.

In some embodiments, first side 160 of second wedge 150 may include recessed portion 204. In some embodiments, recessed portion 204 may allow door stop 100 to seat on uneven surfaces such as tile.

In some embodiments, first side 160 of second wedge may include leading edge 180 and trailing edge 190. In some embodiments, leading edge 180 may include transverse members 182. In some embodiments, transverse members 182 may push dirt, dust, and debris to prevent the debris from interfering with resilient members 164, semi-rigid members 168, or rigid members 166. In some embodiments, trailing edge 190 may abut a wall to provide sufficient clearance for door stop 100 to operate without the door striking the wall.

In some embodiments, door stop 100 may be permanently or semi-permanently mounted to a floor. In some embodiments, door stop 100 may include an adhesive strip (not shown) for more permanent placement of door stop 100 relative to a door. In some embodiments, the adhesive strip has a first adhesive surface for affixing to first side 160 of second wedge 150 and a second adhesive surface for affixing to a floor. In some embodiments, the adhesive strip used to affix door stop 100 to the floor may be a double-back carpet tape commonly found in hardware stores. Advantageously, double-back carpet tape is easy to apply and is unlikely to damage the floor or door stop 100.

One advantage to using an adhesive strip with door stop 100 is the elimination of holes drilled in floors or walls. Embodiments of door stop 100 use gravity and the door hinges to stop the linear force of the door, without the elastic collision, without drilling holes in the floor, without abrupt stoppage of the door, and without damaging the door.

One embodiment may include a plate attached to the floor and door stop 100 attached to the plate. In this embodiment, holes may be drilled in the floor and the plate attached to the floor using pins or screws. One advantage of this type of embodiment is that door stop 100 prevents the door from opening too much, and the plate only positions door stop 100. Thus, the problem of pins breaking or the floor being damaged (seen in prior art approaches) may not exist with door stop 100.

Figure 5:
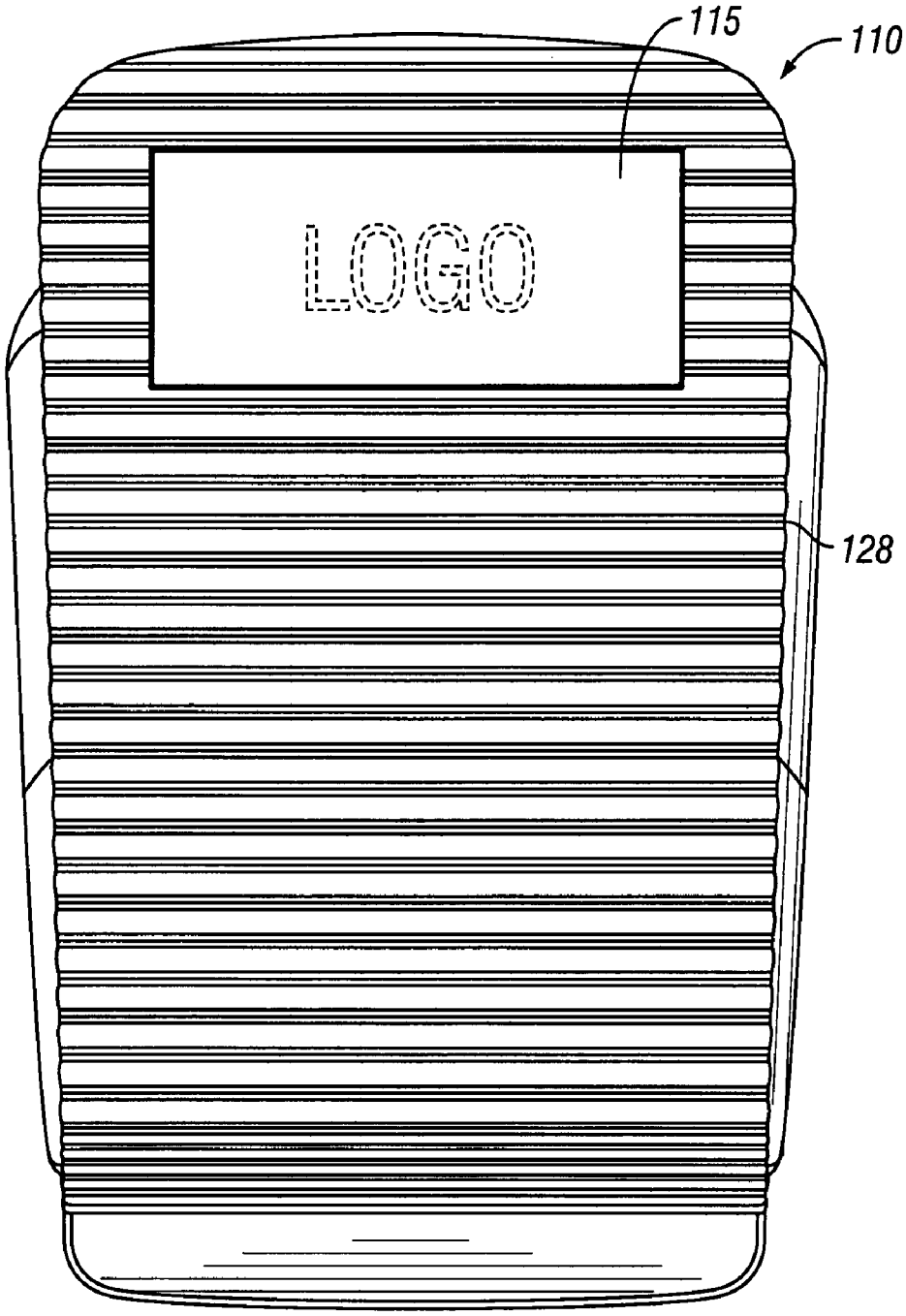
FIG. 5 depicts a top view of one embodiment of a door stop.

FIG. 5 depicts a top view of one embodiment of a device for stopping a door. In some embodiments, first side 120 of first wedge 110 may include extensions 128. In some embodiments, extensions 128 may extend the width of first side 120.

In some embodiments, first wedge 110 may include recessed portion 115. In some embodiments, recessed portion 115 may be used for placement of a logo, a name plate, or some other label. In some embodiments, recessed portion 115 may be used for placement of a light or sensor. In some embodiments, a light may be positioned in the recessed portion and door stop 100 may include a sensor, such that when the sensor detects an alarm condition (e.g. smoke, attempted intrusion), the light may be activated. In some embodiments, first wedge 110 may have extensions such as ribs 120 for engaging a door.

Figure 6A:
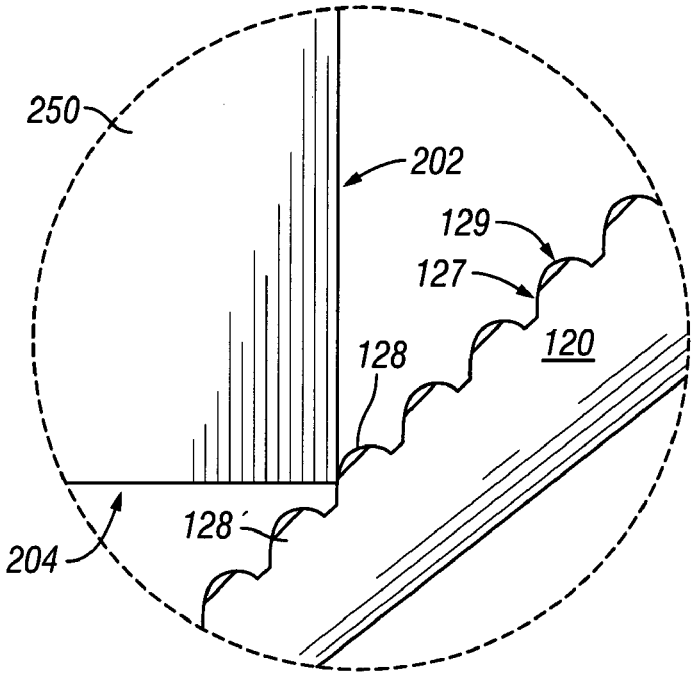
FIGS. 6A and 6B depict close-up side views of a portion of one embodiment of a door stop in contact with a door.
Figure 6B:
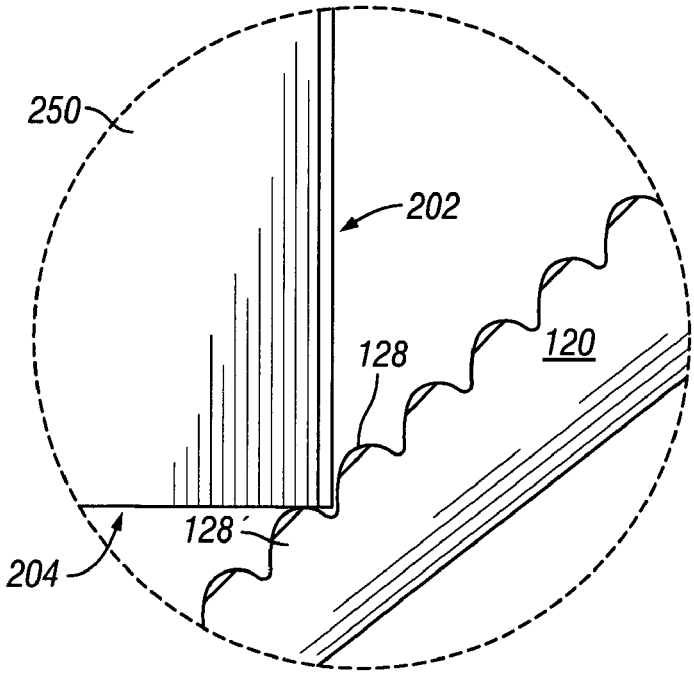

FIGS. 6A and 6B depict close-up side views of a portion of one embodiment of a device for inhibiting movement of a door. FIG. 6A depicts a close-up side view of first side 120 of first wedge 110 in contact with door 250 having side 202 and bottom 204. In some embodiments, first side 120 of first wedge 110 may include a plurality of extensions 128 for engaging door 250. In some embodiments, extensions 128 and 128' may have a first surface 127 and a second surface 129 for engaging door 250. In one embodiment depicted in FIG. 6A, door 250 passes over extension 128' and makes initial contact with extension 128 such that all contact may be between side 202 and first surface 127.

FIG. 6B depicts a close-up side view of first side 120 of first wedge 110 as door 250 continues to move. In some embodiments, first wedge 110 moves relative to second wedge 150 (not shown) such that extension 128' makes contact with door 200. In some embodiments, all contact between extension 128' and door 200 may be between second surface 129 and bottom 204 of door 250. In some embodiments, door stop 100 may have extensions 128 configured such that second surface 129 does not contact side 202 of door 250. In FIG. 6B, second surface 129 contacts only bottom 204 of door 250, and avoids contacting even the bottom of facing 202. One advantage to this embodiment is that in situations in which door 250 is manufactured with facing, kick plate, or other side 202 laminated to bottom 204, door stop 100 reduces the stresses that could damage door 250, such as splitting laminate facing 202 from door 250. This may also further protect first surface 120 from the potentially extremely sharp corner of door 250 such as when door 250 is aluminum with a saw cut bottom. In contrast, wedges that are forced under door 250 tend to damage door 250 by pulling laminated facing 202 from bottom 204. Those skilled in the art will appreciate that the design and spacing of extensions 128 and 128' may be determined by the overall angle of door stop 100, the angle of first wedge 110 or second wedge 150, or door 250.

In some embodiments, door stop 100 may include a third wedge (not shown). Advantageously, first wedge 110, second wedge 150 and third wedge may move independently, or two wedges may connect to configure door stop 100 for a selected purpose. For example, first wedge 110 may have a 3 degree angle and second wedge 150 may have a three degree angle. In some situations, it may be advantageous to have door stop 100 with a 6 degree angle, so first wedge 110 may be temporarily engaged with second wedge 150 to form a wedge having a 6 degree angle.

The foregoing specification and accompanying figures are for the purpose of teaching those skilled in the art the manner of carrying out the disclosure and should be regarded in an illustrative rather than a restrictive sense. As one skilled in the art can appreciate, embodiments disclosed herein can be modified or otherwise implemented in many ways without departing from the spirit and scope of the disclosure and all such modifications and implementations are intended to be included within the scope of the disclosure as set forth in the claims below.

What is claimed is:

1. A door stop comprising:

a first wedge comprising a first side and a second side oriented at an acute angle relative to the first side; and a second wedge glidably connected to the first wedge, comprising a first side and a second side oriented at an acute angle relative to the first side, wherein the first side is configured to be placed into contact with a floor surface and wherein an interface between the first and second wedges is positioned at an acute angle relative to the first side of the second wedge and to the floor surface;

a connection assembly that permits limited, glidable movement of the first wedge relative to the second wedge along the interface between the second side of the first wedge and the second side of the second wedge;

wherein first wedge glides relative to the second wedge to stop a door before reaching a maximum length of travel; and wherein horizontal movement of a door in contact with the first wedge moves the first wedge relative to the second wedge to apply a substantially vertical force on the door to inhibit further movement of the door.

2. The door stop of claim 1, wherein the connection assembly comprises at least one bearing to facilitate movement of the first wedge relative to the second wedge.

3. The door stop of claim 1, wherein the second side of the first wedge defines a curvilinear path, and wherein the second side of the second wedge comprises a complimentary profile for moving the first wedge relative to the second wedge.

4. The door stop of claim 1, further comprising a plurality of extensions on the first side of the first wedge, comprising:

a first surface oriented normal to the first side of the second wedge; and a second surface oriented parallel to the first side of the second wedge, wherein lengths of the plurality of extensions are less than a width of a door such that the extensions may contact the door without contacting laminates on the face of the door so as to not damage the laminates;

wherein the first surface engages the side of a door during initial contact with the door, and wherein the first wedge glides relative to the second wedge such that the second surface engages the bottom of the door.

5. The door stop of claim 1, further comprising a semi-rigid member on the first side of the first or second wedge.

6. The door stop of claim 1, further comprising a rigid member on the first side of the first or second wedge.

7. The door stop of claim 1, comprising a sensor.

8. The door stop of claim 7, wherein the sensor detects smoke.

9. The door stop of claim 7, wherein the sensor detects motion between the first and second wedges.

10. The door stop of claim 1, comprising a light source.

11. The door stop of claim 1, comprising a lanyard attached to the first wedge, wherein pulling on the lanyard pulls the first wedge relative to the second wedge to disengage the door stop from the door.

12. The door stop of claim 1, wherein the first side of the first or second wedge is oriented at an angle between 6 and 40 degrees relative to the second side.

13. The door stop of claim 1, comprising:

an adhesive material having a first adhesive surface for affixing to the first side of the second wedge and a second adhesive surface for affixing with a floor.

14. The door stop of claim 1, wherein the second wedge is permanently affixed to the floor.

15. The door stop of claim 14, comprising:

a plate having a first side for contact with the floor and a second side for contact with the door stop; and a pin for advancement into a floor, wherein the pin permanently affixes the plate to the floor, wherein the door stop is permanently affixed to the plate for permanently affixing the door stop to the floor.

16. A door stop, comprising:

a first wedge having a first side and a second side oriented at an acute angle relative to the first side; and a second wedge glidably connected to the first wedge and having a first side and a second side oriented at an acute angle relative to the first side, wherein the first side is configured to be placed into contact with a floor surface and wherein an interface between the first and second wedges is positioned at an acute angle relative to the first side of the second wedge and to the floor surface;

a connection assembly that permits limited, glidable movement of the first wedge relative to the second wedge along the interface between the second side of the first wedge and the second side of the second wedge;

wherein first wedge glides relative to the second wedge to stop a door before reaching a maximum length of travel;

wherein horizontal movement of a door in contact with the first wedge moves the first wedge relative to the second wedge to apply a substantially vertical force on the door to inhibit further movement of the door;

wherein the first side of the first wedge has a first hardness for contact with a door; and the first side of the second wedge has a second hardness for contact with the floor, wherein one side is softer than the other side.

* * * * *